US007261063B1

(12) United States Patent
Holland

(10) Patent No.: US 7,261,063 B1
(45) Date of Patent: Aug. 28, 2007

(54) APPARATUS AND METHOD FOR USING PURE DRY BIOMASS CARBOHYDRATES AS FUELS, FUEL EXTENDERS, AND FUEL OXYGENATES

(76) Inventor: John J. Holland, 501 Calais Dr., Mesquite, NV (US) 89027

( * ) Notice: Subject to any disclaimer, the term of this patent is extended or adjusted under 35 U.S.C. 154(b) by 0 days.

(21) Appl. No.: 11/427,292

(22) Filed: Jun. 28, 2006

(51) Int. Cl.
*C10L 1/00* (2006.01)

(52) U.S. Cl. ..... 123/1 A; 123/23

(58) Field of Classification Search ..... 123/1 A, 123/23
See application file for complete search history.

(56) References Cited

U.S. PATENT DOCUMENTS 1,432,178 A 10/1922 Greenstreet
1,657,961 A 1/1928 Flores
2,090,393 A 8/1937 Roberts
3,219,657 A 11/1965 Gaertner
4,214,615 A * 7/1980 Boyer ..... 141/363
4,240,379 A * 12/1980 Armbruster ..... 123/23
4,300,482 A * 11/1981 Tinkham ..... 123/23
4,347,061 A 8/1982 Madsen et al.
4,396,786 A 8/1983 Bond et al.
4,425,136 A 1/1984 Pearson et al.
4,659,335 A 4/1987 Wegner et al.
4,705,534 A 11/1987 Yan
5,096,462 A 3/1992 Schulz et al.
6,827,750 B2 * 12/2004 Drozd et al. ..... 44/629
6,860,241 B2 * 3/2005 Martin et al. ..... 123/1 A

* cited by examiner

*Primary Examiner*—Stephen K. Cronin
*Assistant Examiner*—Jason Benton
(74) *Attorney, Agent, or Firm*—Veronica-Adele R. Cao; Harry M. Weiss; Weiss & Moy, P.C.

(57) ABSTRACT

An apparatus and method for using pure dry biomass carbohydrates as fuels, fuel extenders and fuel oxygenates. Preferably, the apparatus and method would be used in internal combustion engines. The apparatus and method disclose the concept of mixing dry carbohydrates with hydrocarbon fuel to create a carbohydrate slurry fuel that burns as efficiently and cleanly as gasoline alone.

26 Claims, 2 Drawing Sheets

APPARATUS AND METHOD FOR USING PURE DRY BIOMASS CARBOHYDRATES AS FUELS, FUEL EXTENDERS, AND FUEL OXYGENATES

FIELD OF THE INVENTION

This invention relates generally to fuel engines and pertains in particular to an apparatus and method for using pure, dry biomass carbohydrates as fuels, fuel extenders and fuel oxygenates.

BACKGROUND OF THE INVENTION

Internal combustion engines are heat engines wherein the burning of a fuel occurs in a confined space (combustion chamber). An exothermic reaction occurs when a fuel reacts with an oxidizer, thereby creating gases of high temperature and pressure. The expanding hot gasses perform useful work, i.e. they cause the movement of the engine itself or the movement of the engine's components, such as its pistons and rotors.

Several types of fuel have been used with internal combustion engines. Today, the most common fuels are those that are made up of hydrocarbons and are derived from petroleum, such as diesel, gasoline, and liquefied petroleum gas. However, increasing world demand for, and diminishing reserves of, petroleum are bringing the golden age of abundant, inexpensive petroleum to an end.

Recently, some have begun using corn-based ethanol as fuels, fuel extenders, and fuel oxygenates. Ethanol fuels are renewable and less polluting because the photosynthesis that provides carbohydrates for ethanol fermentation also converts atmospheric carbon dioxide to oxygen. However, ethanol fuel production also requires energy-intensive, costly, and polluting distillation/desiccation steps, and overall energy yields exceed energy input by only a small margin. There has also been some discussion of developing renewable biomass fuels, with current emphasis on cellulosic ethanol and bio-diesel oil (vegetable oil ester) fuels. However, these present the drawbacks of high energy expenditure for cellulosic ethanol and land-use competition with food and feed crops for biodiesel.

Others have attempted to use powdered coal dust or plant carbohydrates or chemically-modified derivatives of carbohydrates and biomass residues as fuels, fuel-extenders and ignition promoters. However, none of them teach the direct use of dry, non-modified, non-solubilized, non-emulsified carbohydrate powders as fuel and fuel extenders in internal combustion engines.

Therefore, a need existed for an apparatus and method for using pure dry biomass carbohydrates as fuels, fuel extenders and fuel oxygenates. Preferably, the apparatus and method would be used in internal combustion engines. Further preferably, the apparatus and method would provide for more rapid and energy-efficient conversion of the biomass carbohydrates into biomass fuels, fuel extenders, and oxygenates. Further preferably, the dry carbohydrates used for the present invention will be starch, sugars, cellulose, hemicellulose, lignins, or any combination thereof. Still further preferably, the apparatus and method would also be less detrimental to the environment.

SUMMARY OF THE INVENTION

An object of the present invention is to provide an apparatus and a method for using pure biomass carbohydrates as fuels.

Another object of the present invention is to provide an apparatus and a method for using pure biomass carbohydrates as fuel extenders.

Another object of the present invention is to provide an apparatus and a method for using pure biomass carbohydrates as fuel oxygenates.

Another object of the present invention is to provide an apparatus and method for using pure biomass carbohydrates as fuels, fuel extenders, and/or fuel oxygenates in internal combustion engines.

Yet another object of the present invention is to provide an apparatus and method for providing fuels, fuel extenders, and/or fuel oxygenates that are energy efficient and less detrimental to the environment.

BRIEF DESCRIPTION OF THE PREFERRED EMBODIMENTS

In accordance with one embodiment of the present invention an apparatus for using pure carbohydrates as a fuel additive for an engine is disclosed. The apparatus comprises a carbohydrate slurry fuel comprising dry carbohydrates mixed with hydrocarbon fuel, a carbohydrate slurry fuel tank, and a fuel line coupling the carbohydrate slurry fuel tank to the engine.

In accordance with another embodiment of the present invention, an improved internal combustion engine system is disclosed. The improved internal combustion engine system comprises a hydrocarbon fuel tank, a carbohydrate slurry fuel tank, a hydrocarbon fuel line coupling the hydrocarbon fuel tank to the carbohydrate slurry fuel tank, a hopper coupled to the carbohydrate slurry fuel tank for storing dry carbohydrates, and a carbohydrate slurry fuel line coupling the carbohydrate slurry fuel tank to an internal combustion engine.

In accordance with another embodiment of the present invention, a method of improving hydrocarbon fuel performance in an internal combustion engine is disclosed. The method comprises the steps of creating carbohydrate slurry fuel by mixing dry carbohydrates with hydrocarbon fuel, providing a carbohydrate slurry fuel tank for storing the carbohydrate slurry fuel, and delivering the carbohydrate slurry fuel from the carbohydrate slurry fuel tank to the internal combustion engine.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
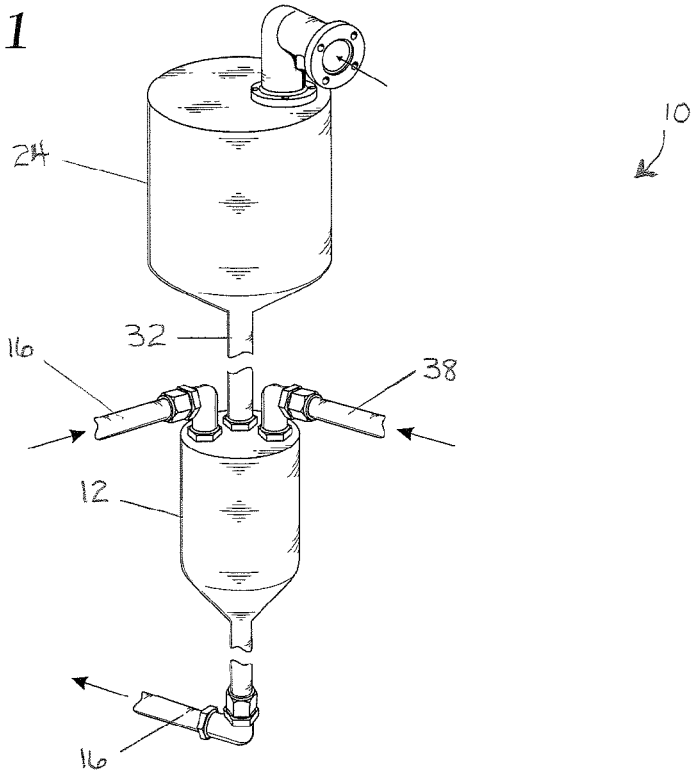
FIG. 1 is a perspective view of the apparatus of the present invention. The apparatus is shown having a hopper, a slurry tank, and a plurality of fuel lines.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

Figure 2:
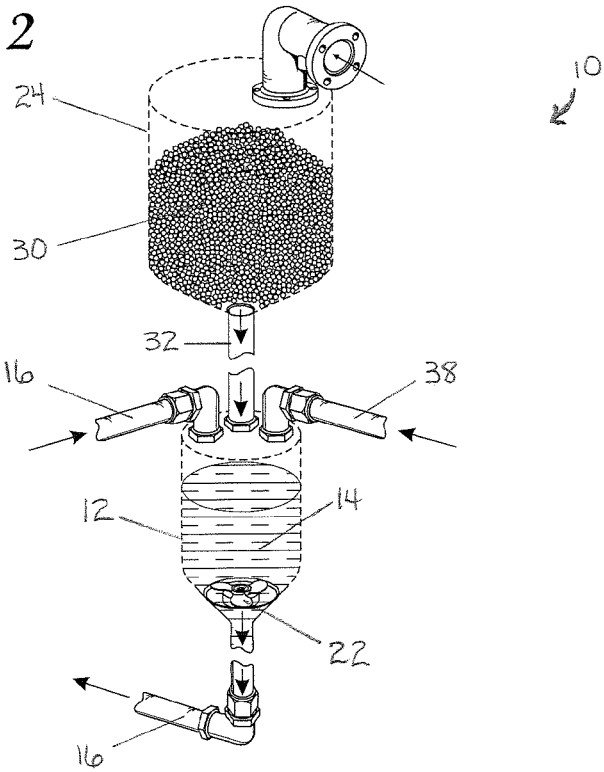
FIG. 2 is a perspective view of the interior of the apparatus of FIG. 1 shown by broken lines. Carbohydrate pellets are shown within the fuel hopper and carbohydrate slurry fuel is shown within the carbohydrate slurry fuel tank.

Referring to FIGS. 1-2, an apparatus, hereinafter referred to as apparatus 10, for using pure carbohydrates 30 as a fuel additive for an engine 18 is disclosed. The apparatus 10 preferably comprises a carbohydrate slurry fuel 14, a carbohydrate slurry fuel tank 12, and a fuel line 16 coupling the carbohydrate slurry fuel tank 12 to the engine 18.

Preferably, the carbohydrate slurry fuel 14 is created by mixing pure dry carbohydrates 30 with hydrocarbon fuel (not shown). Although starch is the preferred carbohydrate 30 used herein, it should be clearly understood that substantial benefit may be derived from the use of sucrose and cellulose as well as a wide variety of saccharides, oligosaccharides or polysaccharides. Further preferably, the hydrocarbon fuel used for the present invention may be diesel, gasoline, or liquefied petroleum gas.

The following experiments were conducted. Those of ordinary skill in the art will realize that the following examples are illustrative only and are not intended to be in any way limiting.

EXAMPLE 1

A new BRIGS AND STRATON lawnmower engine was operated for over ten hours during a period of two weeks using a slurry of unleaded gasoline plus cornstarch at a ratio of 1 lb. of starch: 1 gal. of gasoline. Running times varied from fifteen minutes to over three hours for each run. The engine was always running on small amounts of gasoline when the starch slurry fuel was additionally added, and refueling of the gas tank during prolonged runs with slurry fuel was done with the engine running full throttle. The slurry fuel in the tank was kept partially-suspended by constant agitation of the entire mower and by occasional stirring with the gas cap removed. The engine operated strongly at the factory-preset high speed with no smoking, soot or dust evident from the exhaust and no loss of power even when very thick sections of heavy grass were mowed with the twenty-inch rotary cutter adjusted to a low height above ground level. At no time was any irregular running or sputtering or power diminution observed. The engine oil and spark plug remained clean over the ten hours of operation.

During one run the slurry consisted (volume to volume) of one part gasoline, ¼ part packed cellulose powder (finely ground from high quality paper, then sieved), and less than 5% added corn starch power. This slurry also fueled the engine as efficiently and cleanly as did gasoline alone.

EXAMPLE 2

A WEEDEATER trimmer with a two-stroke engine operated efficiently using a gasoline slurry fuel with a 1:8 volume/volume cornstarch to hydrocarbon fuel ratio. No increase in smoke, soot, or dust was evident during more than one hour of operation at full throttle while constantly agitating the fuel mixture. Powdered confectioners sucrose at the same ratio to gasoline also exhibited normal operation on this sugar-hydrocarbon slurry fuel on runs exceeding one hour. No evidence of engine fouling was observed. Therefore, powdered monosaccharides or disaccharides are as effective as slurry fuels as are polysaccharides.

EXAMPLE 3

Another WEEDEATER trimmer engine with a properly-perforated candle-type fuel filter operated efficiently and cleanly using either a 25% slurry of sucrose in gasoline or a 25% slurry of cornstarch in gasoline, even though starch aggregates of 1 mm or more in size could be seen flowing up the clear plastic fuel line to the carburetor. Considerable amounts of aggregated carbohydrate failed to pass the perforated filter into the fuel line, and remained in the fuel tank after fuel depletion. Therefore, even aggregated slurry fuels may still undergo nearly-complete combustion if they reach the carburetor and atomize well.

The fact that the carbohydrate slurry fuel 14 burned cleanly and with no detectable increase in exhaust smoke or soot indicates nearly-complete combustion of both the hydrocarbon and the carbohydrate in slurries. It therefore follows that the free energy released by carbohydrate combustion to hot gases in cylinders must, in accord with the first law of thermodynamics, help to drive the engine 18.

The carbohydrate slurry fuel 14 may be premixed at fuel depots or refinery areas. Delivery tankers would therefore preferably have mixers operating in their tanks prior to dispensing these slurry fuels into underground service station tanks. The underground service station tanks would also preferably keep their carbohydrate slurry fuel 14 mixed as a fully-suspended slurry during all hours of operation. Such constant mixing would help to prevent fuel line and engine fouling.

In the alternative, the dry carbohydrates 30 could be mixed with the hydrocarbon fuel within the apparatus 10 itself. The dry carbohydrates 30 would preferably be stored within a hopper 24. The dry carbohydrates 30 would further preferably pass through a dry carbohydrate fuel line 32 into a carbohydrate slurry fuel tank 12. Hydrocarbon fuel from a hydrocarbon fuel tank 36 will pass through a hydrocarbon fuel line 38 and will enter the carbohydrate slurry fuel tank 12 where it will be mixed with the dry carbohydrates 30 to form the carbohydrate slurry fuel 14. A carbohydrate slurry fuel line 16 will then deliver the carbohydrate slurry fuel 14 from the carbohydrate slurry fuel tank 12 to the engine 18.

The dry carbohydrates 30 may be in either powder or pellet form. If in pellet form, the pellets may comprise a binder that was soluble in hydrocarbon fuel, therefore causing the pellet to break down into powder form once in contact with the hydrocarbon fuel. If the pellet does not comprise a binder that is soluble in hydrocarbon fuel, the apparatus 10 may further comprise a milling device 26 to crush or grind the pellets to convert them into powder form. The powder may then either fall through the dry carbohydrate fuel line 32 directly into the carbohydrate slurry fuel tank 12 or it may be conveyed to the carbohydrate slurry fuel tank 12 via a rotary drive train 34 housed within the dry carbohydrate fuel line 32. The milling device 26 and the rotary drive train 34 could be powered by at least one auxiliary motor 28.

When vehicles are idle, settling of carbohydrate 30 powders may occur. In order to help prevent engine fouling, it is preferred that the carbohydrate slurry fuel tank 12 comprise at least one agitator 22 to mix the carbohydrate slurry fuel 14. Frequent-to-constant mixing and recirculation through fuel lines will allow the carbohydrates 30 to remain suspended within the hydrocarbon fuel and to prevent aggregates from forming and blocking any fuel lines or other engine components. Another way to help prevent engine fouling would be to place a metal sieve-filter (not shown) immediately prior to the point where carbohydrate slurry fuel 14 would enter the fuel injector. This would help to finely disperse any loose aggregates of powdered carbohydrates 30.

Yet another way to help prevent engine fouling is to maintain a low concentration of carbohydrate 30 in the carbohydrate slurry fuel 14. Oxygen comprises slightly more than half of the molecular weight of carbohydrates 30. Therefore, a 4% slurry of carbohydrate in hydrocarbon fuel would be able to provide the 2% by weight oxygen content previously mandated for petroleum oxygenates to promote more complete fuel combustion. The rather low concentration of 4% dry carbohydrate 30 powder in a hydrocarbon slurry would allow easier management of aggregation although it would occur at a somewhat slower rate.

Figure 3:
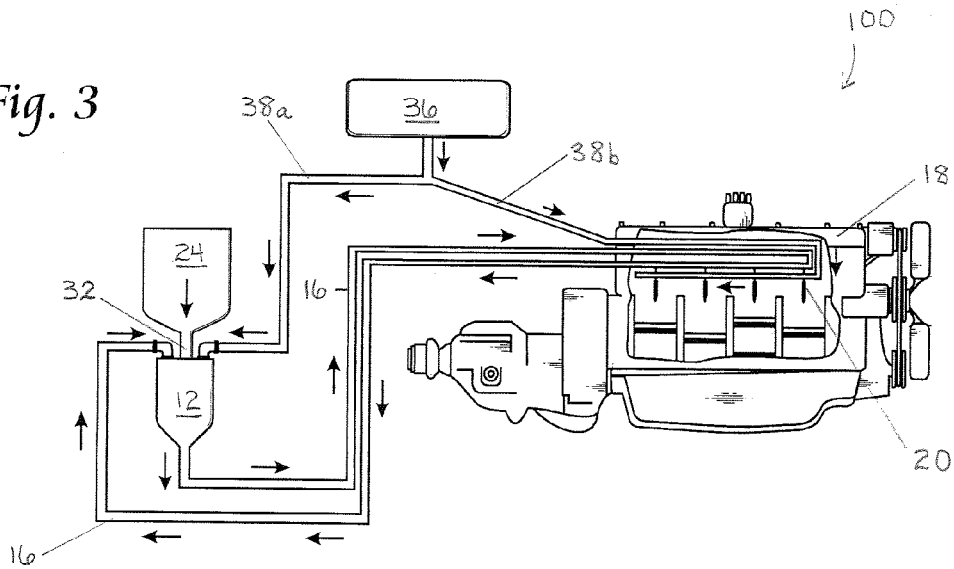
FIG. 3 is a side view of the apparatus of FIG. 1 being used with an engine.
Figure 4:
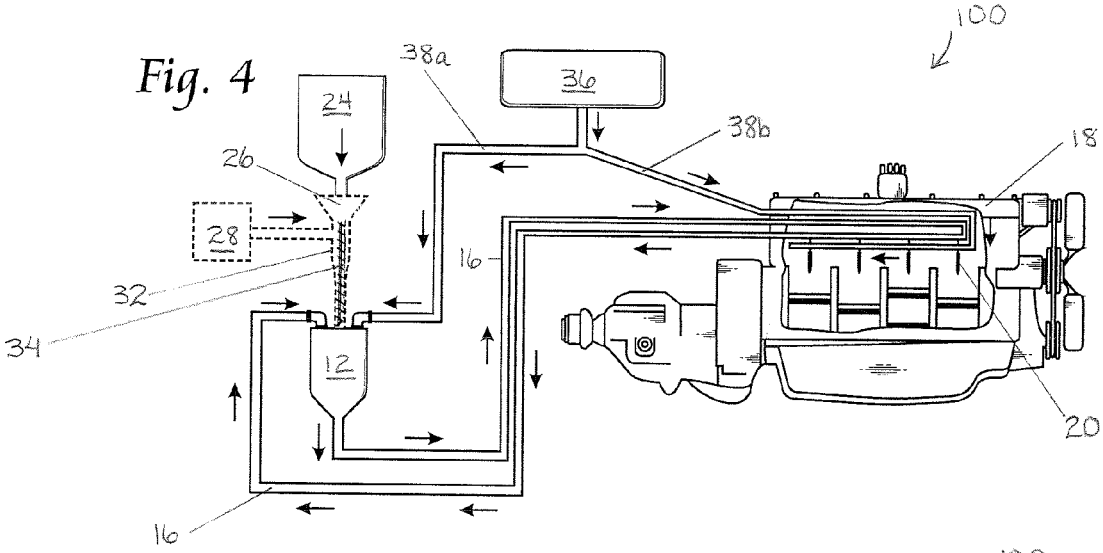
FIG. 4 is a side view of the apparatus of FIG. 1 being used with an engine. The only difference is the addition of a milling device between the hopper and the carbohydrate slurry fuel tank.
Figure 5:
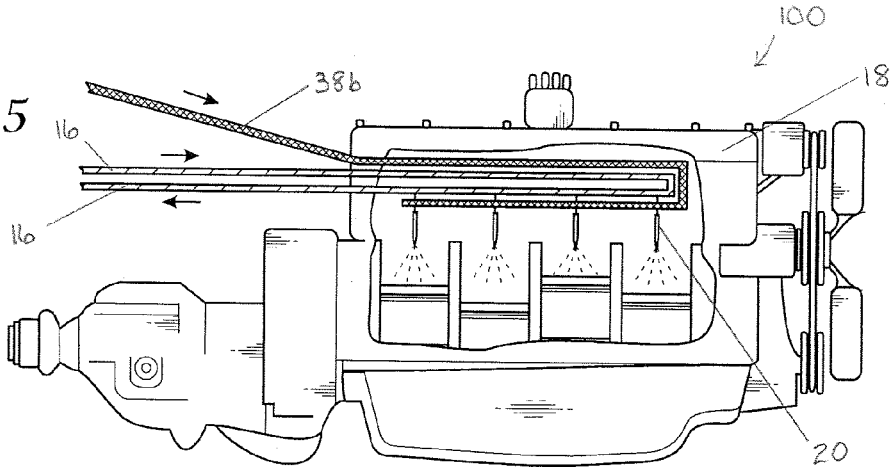
FIG. 5 is a side view of an engine using the apparatus of FIG. 1.

Referring now to FIGS. 3-5, an improved internal combustion engine system, hereinafter referred to as system 100, is shown. Preferably, the system 100 comprises two separate fuel tanks and lines. A carbohydrate slurry fuel line 16 would deliver carbohydrate slurry fuel 14 from a carbohydrate slurry fuel tank 12 to the engine 18. A hydrocarbon fuel line 38*a* (referred to generically as hydrocarbon fuel line 38) would deliver hydrocarbon fuel from a hydrocarbon fuel tank 36 to the carbohydrate slurry fuel tank 12 where the hydrocarbon fuel will be mixed with dry carbohydrates 30. Further preferably, a second hydrocarbon fuel line 38*b* (referred to generically as hydrocarbon fuel line 38) would deliver pure hydrocarbon fuel to the engine 18. While it is preferred that the system 100 comprise the second hydrocarbon fuel line 38*b*, it should be clearly understood that substantial benefit may be derived from a system 100 that does not have a second hydrocarbon fuel line 38*b* and from a system 100 that has more than two hydrocarbon fuel lines 38.

Preferably, the pure hydrocarbon fuel that would be delivered directly to the engine 18 from the hydrocarbon fuel tank 36 via the second hydrocarbon fuel line 38*b* would automatically drive the engine 18 for an additional period of time (with the ignition system staying on) after the ignition key is turned off. This would help to eliminate unburned carbohydrate 30 residues that could otherwise remain in the engine 18 after shutdown. Further preferably, when starting a cold engine 18, the pure hydrocarbon fuel would automatically be delivered directly to the engine 18 for a period of time until the engine 18 is warmed up. After the engine 18 is warmed, carbohydrate slurry fuel 14 would preferably be used continuously until initiating engine 18 shutdown.

Dry carbohydrates 30 precipitated in carbohydrate slurry fuel lines 16 may be suspended quickly if the carbohydrate slurry fuel line 16 forms a complete circuit back to the carbohydrate slurry fuel tank 12 during start-up and during operation. This will continuously move separated fuel mixture into the stirred carbohydrate slurry fuel tank 12 for full suspension. Additional hydrocarbon fuel from the hydrocarbon fuel tank 36 may also be delivered to the carbohydrate slurry fuel tank 14 via the hydrocarbon fuel line 38 to restore the desired concentration of the carbohydrate slurry fuel 14 prior to the carbohydrate slurry fuel 14 being recycled to the fuel injectors 20 of the engine 18. While it is preferred that the engine 18 be one that uses electronic fuel injectors 20, it should be clearly understood that further substantial benefit may be derived from use of the invention with a carbureted engine (not shown).

While the invention has been particularly shown and described with reference to preferred embodiments thereof, it will be understood by those skilled in the art that the foregoing and other changes in form and details may be made therein without departing from the spirit and scope of the invention.

I claim:

1. An apparatus for using pure carbohydrates as a fuel additive for an engine, said apparatus comprising:

a carbohydrate slurry fuel comprising dry carbohydrates mixed with hydrocarbon fuel;

a carbohydrate slurry fuel tank;

a fuel line coupling said carbohydrate slurry fuel tank to said engine;

a hopper for storing dry carbohydrates coupled to said carbohydrate slurry fuel tank;

a dry carbohydrate fuel line coupling said hopper to said carbohydrate slurry fuel tank; and at least one rotary drive device to convey said dry carbohydrates through said dry carbohydrate fuel line.

2. The apparatus of claim 1 wherein said carbohydrate slurry fuel tank comprises an agitator for mixing said carbohydrate slurry fuel.

3. The apparatus of claim 1 wherein said carbohydrate slurry fuel line delivers said carbohydrate slurry fuel to said engine.

4. The apparatus of claim 1 wherein said dry carbohydrates being in one of powder form and pellet form.

5. The apparatus of claim 1 wherein said dry carbohydrates being at least one of starch, sugar, cellulose, hemicellulose, and lignins.

6. The apparatus of claim 4 wherein said dry carbohydrates being in pellet form, and wherein said apparatus further comprises a milling device coupled below said hopper, said milling device for converting said pellets into powder form.

7. The apparatus of claim 4 wherein said dry carbohydrates being in pellet form and wherein said pellets comprising a binding material dissolvable in hydrocarbon fuel.

8. An improved internal combustion engine system comprising:

a hydrocarbon fuel tank;

a carbohydrate slurry fuel tank;

a hydrocarbon fuel line coupling said hydrocarbon fuel tank to said carbohydrate slurry fuel tank;

a hopper coupled to said carbohydrate slurry fuel tank for storing dry carbohydrates;

a carbohydrate slurry fuel line coupling said carbohydrate slurry fuel tank to an internal combustion engine;

wherein said dry carbohydrates being in pellet form, and wherein said apparatus further comprises a milling device coupled below said hopper, said milling device for converting said pellets into powder form.

9. The system of claim 8 further comprising a second hydrocarbon fuel line coupling said hydrocarbon fuel tank to said internal combustion engine.

10. The system of claim 8 wherein said carbohydrate slurry fuel line conveys carbohydrate slurry fuel from said internal combustion engine back to said carbohydrate slurry fuel tank.

11. The apparatus of claim 8 further comprising at least one rotary drive device to convey said dry carbohydrates through a dry carbohydrate fuel line coupling said hopper to said carbohydrate slurry fuel tank.

12. A method of improving hydrocarbon fuel performance in an internal combustion engine comprising the steps of:

providing a carbohydrate slurry fuel tank for storing carbohydrate slurry fuel;

creating said carbohydrate slurry fuel by mixing dry carbohydrates with hydrocarbon fuel, wherein creating said carbohydrate slurry fuel comprises the steps of:

providing a hydrocarbon fuel tank;

providing a hydrocarbon fuel line coupling said hydrocarbon fuel tank to said carbohydrate slurry fuel tank;

providing a hopper coupled to said carbohydrate slurry fuel tank for storing dry carbohydrates, said dry carbohydrates being in pellet form;

providing a milling device coupled between said hopper and said carbohydrate slurry fuel tank;

converting said pellets into powder form by said milling device;

delivering hydrocarbon fuel to said carbohydrate slurry fuel tank;

delivering said dry carbohydrates to said carbohydrate slurry fuel tank;

mixing said dry carbohydrates with said hydrocarbon fuel within said carbohydrate slurry fuel tank; and delivering said carbohydrate slurry fuel from said carbohydrate slurry fuel tank to said internal combustion engine.

13. The method of claim 12 further comprising the steps of:

delivering said carbohydrate slurry fuel from said internal combustion engine back to said carbohydrate slurry fuel tank; and recycling said carbohydrate slurry fuel through said internal combustion engine.

14. The method of claim 12 further comprising the steps of:

delivering only said hydrocarbon fuel to said internal combustion engine for a preset period of time following ignition of said internal combustion engine; and delivering only said hydrocarbon fuel to said internal combustion engine for a preset period of time prior to shutdown of said internal combustion engine.

15. An apparatus for using pure carbohydrates as a fuel additive for an engine, said apparatus comprising:

a carbohydrate slurry fuel comprising dry carbohydrates mixed with hydrocarbon fuel, wherein said dry carbohydrates being in one of powder form and pellet form;

a carbohydrate slurry fuel tank;

a fuel line coupling said carbohydrate slurry fuel tank to said engine; and wherein said dry carbohydrates being in pellet form, said apparatus further comprising a milling device coupled below said hopper, said milling device for converting said pellets into powder form.

16. The apparatus of claim 15 wherein said carbohydrate slurry fuel tank comprises an agitator for mixing said carbohydrate slurry fuel.

17. The apparatus of claim 15 wherein said carbohydrate slurry fuel line delivers said carbohydrate slurry fuel to said engine.

18. The apparatus of claim 15 further comprising a hopper for storing dry carbohydrates coupled to said carbohydrate slurry fuel tank.

19. The apparatus of claim 18 further comprising a dry carbohydrate fuel line coupling said hopper to said carbohydrate slurry fuel tank.

20. The apparatus of claim 19 further comprising at least one rotary drive device to convey said dry carbohydrates through said dry carbohydrate fuel line.

21. The apparatus of claim 15 wherein said dry carbohydrates being at least one of starch, sugar, cellulose, hemicellulose, and lignins.

22. The apparatus of claim 15 wherein said dry carbohydrates being in pellet form and wherein said pellets comprising a binding material dissolvable in hydrocarbon fuel.

23. An improved internal combustion engine system comprising:

a hydrocarbon fuel tank;

a carbohydrate slurry fuel tank;

a hydrocarbon fuel line coupling said hydrocarbon fuel tank to said carbohydrate slurry fuel tank;

a hopper coupled to said carbohydrate slurry fuel tank for storing dry carbohydrates;

a carbohydrate slurry fuel line coupling said carbohydrate slurry fuel tank to an internal combustion engine; and at least one rotary drive device to convey said dry carbohydrates through a dry carbohydrate fuel line coupling said hopper to said carbohydrate slurry fuel tank.

24. The system of claim 23 further comprising a second hydrocarbon fuel line coupling said hydrocarbon fuel tank to said internal combustion engine.

25. The system of claim 23 wherein said carbohydrate slurry fuel line conveys carbohydrate slurry fuel from said internal combustion engine back to said carbohydrate slurry fuel tank.

26. The system of claim 23 wherein said dry carbohydrates being in pellet form, and wherein said apparatus further comprises a milling device coupled below said hopper, said milling device for converting said pellets into powder form.

* * * * *